US006958463B1

(12) United States Patent
Kochman et al.

(10) Patent No.: US 6,958,463 B1
(45) Date of Patent: Oct. 25, 2005

(54) HEATER WITH SIMULTANEOUS HOT SPOT AND MECHANICAL INTRUSION PROTECTION

(75) Inventors: Eric Kochman, Highland Park, IL (US); Grahame Gerrard, Parbold (GB); Dmitry Kochman, Vernon Hills, IL (US)

(73) Assignee: Thermosoft International Corporation, Buffalo Grove, IL (US)

( * ) Notice: Subject to any disclaimer, the term of this patent is extended or adjusted under 35 U.S.C. 154(b) by 0 days.

(21) Appl. No.: 10/830,038

(22) Filed: Apr. 23, 2004

(51) Int. Cl.[7] ..... H05B 3/50

(52) U.S. Cl. ..... 219/544; 219/494; 219/505; 219/506

(58) Field of Search ..... 219/528, 549, 219/517, 506, 505, 509, 529, 494, 388, 400, 219/213, 544; 338/20

(56) References Cited

U.S. PATENT DOCUMENTS

| | | | |
|---|---|---|---|
| 1,703,005 | A | 2/1929 | Hewitt |
| 2,496,279 | A | 2/1950 | Ely et al. |
| 2,820,085 | A | 1/1958 | Crowley |
| 3,349,359 | A | 10/1967 | Morey |
| 3,385,959 | A | 5/1968 | Ames et al. |
| 3,627,981 | A | 12/1971 | Kuhn |
| 3,657,516 | A | 4/1972 | Fujihara |
| 3,774,299 | A | 11/1973 | Sato et al. |
| 3,808,403 | A | 4/1974 | Kanaya et al. |
| 3,825,870 | A | 7/1974 | Ono et al. |
| 3,935,422 | A | 1/1976 | Barnes et al. |
| 4,051,094 | A | 9/1977 | Reuter et al. |
| 4,149,066 | A | 4/1979 | Niibe |
| 4,250,397 | A | 2/1981 | Gray |
| 4,309,596 | A | 1/1982 | Crowley |
| 4,523,086 | A | 6/1985 | Eilentropp |
| 4,538,054 | A | 8/1985 | de la Bretoniere et al. |
| 4,607,154 | A | 8/1986 | Mills |
| 4,713,531 | A | 12/1987 | Fennekels et al. |
| 4,742,212 | A | 5/1988 | Ishii et al. |
| 4,764,665 | A | 8/1988 | Orban et al. |
| 4,792,662 | A | 12/1988 | Kitagaki et al. |
| 4,825,049 | A | 4/1989 | Rickborn |
| 4,969,840 | A | 11/1990 | Ii et al. |
| 4,983,814 | A | 1/1991 | Ohgushi et al. |

(Continued)

FOREIGN PATENT DOCUMENTS

| | | |
|---|---|---|
| DE | 21 48 191 | 4/1973 |

(Continued)

*Primary Examiner*—Robin O. Evans
*Assistant Examiner*—Leonid M. Fastovsky
(74) *Attorney, Agent, or Firm*—Berenato, White & Stavish LLC

(57) ABSTRACT

An electrical heater utilizes negative temperature coefficient material (NTC) and current imbalance between live and neutral ends of the heater to simultaneously protect the heater from the hot spot and mechanical intrusion into the heating cable. The NTC layer, separating the heating wire and current leakage conductor, becomes electrically conductive at the temperatures above 60° C., thus "leaking" the current to earth. The hot spot is detected by measuring the current imbalance between line and neutral connections of the heating cable. The mechanical intrusion into the heater, such as cable or insulation damage, water or sharp metal object penetration, is also simultaneously measured by the same current imbalance measuring system such as Ground Fault Circuit Interrupter (GFCI). The optional return conductor and metal foil/mesh hot spot detection shields cancel electromagnetic field. The heater may contain positive temperature coefficient (PTC) continuous sensor to control the temperature in the heater. Such PTC sensor can be made of electrically conductive fibers and/or metal wires.

19 Claims, 5 Drawing Sheets

U.S. PATENT DOCUMENTS 5,023,433 A 6/1991 Gordon
5,068,518 A 11/1991 Yasuda
5,298,722 A 3/1994 Tanaka
5,412,181 A 5/1995 Giamati
5,643,480 A 7/1997 Gustavsson et al.
5,801,914 A 9/1998 Thrash
5,824,996 A 10/1998 Kochman et al.
5,912,811 A * 6/1999 Mackta ..... 363/45
6,031,214 A 2/2000 Bost et al.
6,078,025 A 6/2000 Yeung
6,288,372 B1 * 9/2001 Sandberg et al. ..... 219/544
6,300,598 B1 * 10/2001 Chiles et al. ..... 219/213
6,310,332 B1 10/2001 Gerrard
6,737,610 B1 * 5/2004 Horn et al. ..... 219/212

FOREIGN PATENT DOCUMENTS

| | | |
|---|---|---|
| DE | 32 33 904 | 3/1984 |
| DE | 32 43 061 | 5/1984 |
| FR | 2 323 289 | 4/1977 |
| FR | 2 590 433 | 5/1987 |
| GB | 1 243 898 | 8/1971 |
| JP | 07 006867 | 1/1995 |
| WO | WO95/33358 | 12/1995 |
| WO | WO98/01009 | 1/1998 |
| WO | WO98/09478 | 3/1998 |

* cited by examiner

HEATER WITH SIMULTANEOUS HOT SPOT AND MECHANICAL INTRUSION PROTECTION

BACKGROUND OF INVENTION

1. Field of Invention

This invention relates to a method of hot spot detection and overheating protection of flexible electrical heaters, which have strong metal or carbon containing electrical conductors and insulation with semi-conductive temperature sensitive properties.

2. Description of the Prior Art

Heating elements have extremely wide applications in household items, construction, industrial processes, etc. Their physical characteristics, such as thickness, shape, size, strength, flexibility and other characteristics affect their usability in various applications.

Numerous types of thin and flexible heating elements have been proposed. For example, U.S. Pat. No. 5,861,610 to John Weiss describes the heating wire, which is formed with a first conductor for heat generation and a second conductor for sensing. The first conductor and a second conductor are wound as coaxial spirals with an insulation material electrically isolating two conductors. The two spirals are counter-wound with respect to one another to insure that the second turns across, albeit on separate planes, several times per inch. One of the conductors acts as a heater and another conductor works as a sensing Positive Temperature Coefficient (PTC) wire with predetermined electrical resistance characteristics. The described construction results in a temperature sensing system, which can detect only the average change of resistance in the sensing wire due to elevation of the temperature in the heated product. Therefore, in the event of overheating of a very small surface area (hot spot) of the electric blanket or pad (for example, several square inches), the sensor may fail to detect a minor change of electrical resistance (due to operating resistance tolerance) in the long heating element. In addition, such heating cable does not have inherent Thermal-Cut-Off (TCO) capabilities in the event of malfunction of the controller.

Gerrard (U.S. Pat. No. 6,310,332) describes an elongated heating element for an electric blanket comprising a first conductor means to provide heat for the blanket and extending lengthwise of the element, a second conductor means extending lengthwise of the element, and a meltdown layer between the first and second conductor means which is selected, designed and constructed or otherwise formed so as to display a negative temperature coefficient (NTC), and including an electronic controller set to detect a change in the resistance of the meltdown layer to provide a means of changing the power supply to the first conductor means (providing heat to the blanket), to prevent destruction of the melt down layer. The element further includes a meltdown detection circuit for detecting meltdown of the meltdown layer and for terminating power to the first conductor means in the event that the control means fails and the meltdown layer heats up to a pre-determined degree. The disadvantage of this construction is that the final safety of the blanket relies on a complex NTC/meltdown detection system located in the controller. In the event of controller failure, or significant delays in the detection of the NTC layer meltdown, severe scorching of the heating product or a fire can occur. The Gerrard heating system always requires separate sensing PTC wire, attached to the controller to detect overheating or hot spots. Such passive PTC sensing conductor needs an additional pair of lead wires going from the heater to the sensing control system, which increases weight, size and cost of the heating systems.

Another disadvantage of Gerrard's invention is that its control system utilizes a half-wave power cycle for heating and another half-wave power cycle for meltdown stroke detection in order to provide proper heating output and meltdown protection. Therefore, the heating wire has to be twice as thick as systems utilizing a full-wave power output. This feature becomes especially challenging for 120V and other lower voltage heating systems, compared to traditional European 240V systems. Increased thickness of the heating wire leads to: (a) increased cost of the heating conductor; (b) increased overall size of the heating element and (b) increased heating wire susceptibility to breaking due to reduced flexibility.

Kochman (U.S. Pat. No. 6,713,733) describes a soft and flexible heater which utilizes electrically conductive threads or fibers as heating media. The conductive fibers are encapsulated by negative temperature coefficient (NTC) material, forming temperature sensing heating cables. The heater may contain continuous positive temperature coefficient (PTC) temperature sensors to precisely control the temperature in the heater. The disadvantage of this system is that it requires at least two independent conductors connected to the control system. The first conductor acts as a heating means and the second conductor acts as a heat detection conductor. The NTC hot spot detection system becomes less sensitive with increase of the length of the cable. The heating means and heat detection conductor require separate connections by lead wires to the controller. The electronics which detect overheating use a signal (drop of potential) which transfers to the electronic controllers through heat sensing conductors. The addition of heat sensing conductors for signal transfer and the addition of extra lead wires, results in increased size of the heating cable and lead wire cord, thereby reducing their flexibility and increasing their weight and cost.

The present invention seeks to alleviate the drawbacks of the prior art and describes the novel method of hot spot detection, overheat protection and the fabrication of a heater comprising at least one of the following heating means: metal wires, metal fibers, metal coated, carbon containing or carbon coated threads/fibers, which results in a flexible, strong, heating element core. A preferred embodiment of the invention consists of utilizing electrically conductive textile threads/fibers having an inherent Thermal Cut Off (TCO) function to prevent overheating and/or fire hazard. However, the proposed heaters preferably contain metal conductors or combination of metal wires and conductive textile fibers. The system utilizes an NTC sensing layer for hot spot detection, which does not require having low-temperature meltdown characteristics. The heaters described in this invention may also comprise a continuous temperature PTC sensor to precisely control heating power output in the heating product. The system comprises a current leakage conductor and an electronic or electromechanical device for detecting and comparing the current imbalance in the heater. One of such devices may contain Ground Fault Circuit Interrupter (GFCI), which is also commonly known as "Earth Leakage Circuit Breaker" (ELCB)) to detect current imbalance in the heater due to current leakage through the NTC sensing layer from the heating means to the current leakage conductor. Simultaneously, the same GFCI or other current leakage detecting device can protect the heating cable from mechanical intrusion in the heating cable. Such mechanical intrusion may be in the form of moisture (water) penetration, heating element damage or direct electrical contact between the heating means and the ground conductor due to metallic intrusion inside the heating cable.

SUMMARY OF THE INVENTION

A first objective of the invention is to provide a method of detecting and preventing hot spots. In order to achieve the first objective at least one negative temperature coefficient (NTC) layer is attached to the heating means to provide current leakage to (a) ground/earth conductor or (b) special current leakage conductor, connected either to live or neutral current supply lead wire. The ends of the heating means are connected to the current detectors of GFCI (or ELCB), or other electronic system which detects an imbalance between the "live" and "neutral" ends of the heating cable and disconnects electrical continuity in the heating system at predetermined current limiting settings. It is preferable that the NTC layer covers the heating means through the entire length of the heating element. It is also preferable that the ground shield (such as mesh or foil) and/or ground wire has a sufficient electrical connection with the NTC layer through the entire length of the heating cable.

The second objective of the invention is to provide a significantly safe and more reliable heater which can function properly after it has been subjected to folding, kinks, punctures or crushing. In order to achieve the second objective, the heater of the present invention may comprise (a) electrically conductive threads/fibers and/or metal wires or combination thereof, and (b) multi-layer insulation of the whole heating cable. The electrically conductive fibers may be comprised of carbon, metal fibers, and/or textile threads coated with one or combination of the following materials: metal, carbon and/or electrically conductive ink. The multi-layer insulation of the electrically conductive threads/fibers provides increased dielectric properties, preventing or minimizing current leakage in the event of abuse of the heater. The insulation means may be applied in the form of encapsulation (through extrusion process) or lamination with insulating synthetic materials, having similar or different thermal and mechanical characteristics.

The present invention describes a method of hot spot detection and overheating protection of the heater. It can be manufactured in various shapes, and it can be designed for a wide range of parameters, including but not limited to input voltage, temperature, power density, type of current (AC or DC) and method of electrical connection (parallel or in series).

The heater contains current leakage conductor which may have a shape of a foil, mesh and/or bare wires, which provide current leakage path to the grounded electrode conductor of the housing electrical circuit in the event of heating cable damage, moisture penetration, metal intrusion onto the cable or local overheating of the NTC sensing layer.

The NTC sensing layer usually separates the heating means and/or the return wire from the current leakage conductor, provided that they have good electrical and mechanical connection.

The optional electrically conductive textile fibers also act as a continuous thermal fuse, terminating or reducing electrical continuity in the heater at the temperatures 110° C.–350° C. if dictated by the heating element design.

DETAILED DESCRIPTION OF THE INVENTION

Figure 1:
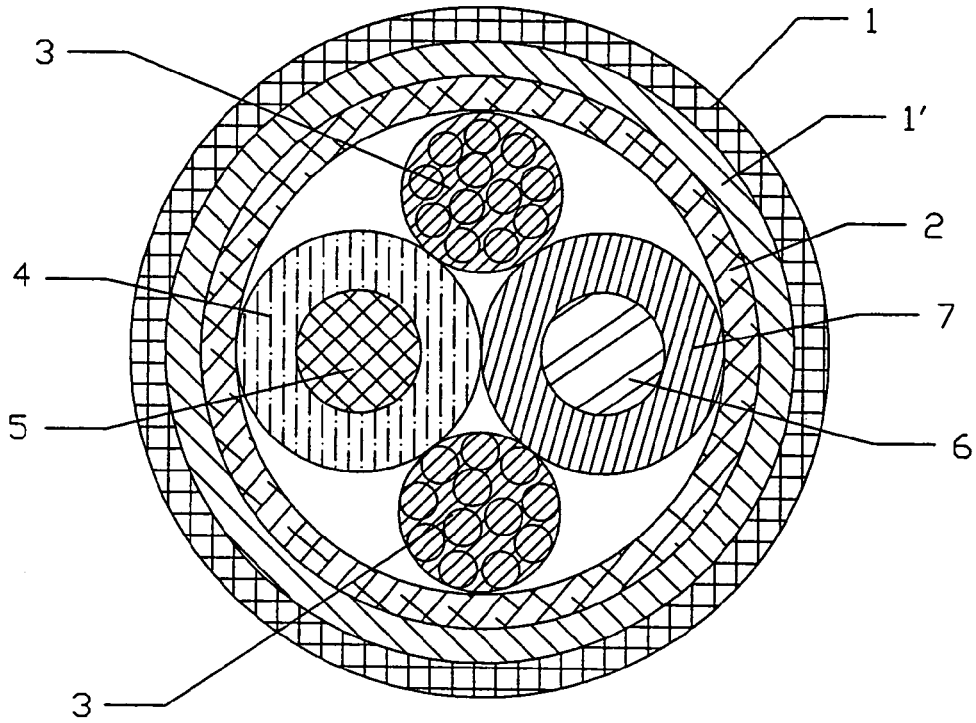
FIG. 1 shows a cross section of a heating cable consisting of two layers of outer insulation means, current leakage conductors, heating means covered by NTC sensing material and an insulated return conductor.

The invention consists of a heating element containing: (a) at least metal wires or metal/carbon containing textile fibers or combination thereof as heating means, insulated by at least one layer of NTC sensing means, (b) current leakage conductor, electrically connected with NTC sensing means and (b) at least one outer insulation of the heater. The invention describes a method of hot spot detection and overheating protection, using a combination of heating means, NTC layer, current leakage conductor and electronic controller, which detects the current imbalance between the live end and the neutral end of the heater.

The term "conductive means" or "conductor" described in this invention shall mean at least one of the following electrically conductive materials: metal wires, metal mesh or metal foil, electrically conductive textile fibers, electrically conductive polymers and other conductive materials, suitable for the purpose of this invention.

The term "heating means" described in this invention shall mean electrical conductor, which is used for heat radiation or current return from live to neutral connections, upon application of predetermined voltage to the heater. As an example, the electrically conductive textile fibers, or metal wires or combination thereof may be considered as heating means. The return conductor, applied in some embodiments of the invention is also considered a heating means.

The term "return conductor" described in this invention shall mean a second heating means which may be placed inside the heating cable and connected (bridged) with the first insulated heating means at one end of the heating cable. Usually the return conductor is encapsulated by insulation means or by NTC sensing means in the same manner as the first heating means. Therefore, in some embodiments of the invention, the return conductor alone may provide the NTC current leakage for hot spot detection.

The term "heating cable" or "temperature sensing heating cable" described in this invention shall mean a heater, or portion thereof, which contains at least one of the following components: heating means, sensing means, current leakage conductor and outer insulation. The heating cable may also contain at least one of the following sensing means: (a) NTC sensing means, or (b) PTC temperature sensing means. Usually the heating cable comprises heating means encapsulated by NTC sensing means, which has good electrical and mechanical connection with the current leakage conductor. The heating cable has at least one layer of the outer insulation means, which insulates all electrical conductors including the heating means, NTC and/or PTC temperature sensing means and the current leakage conductor.

The term "heating cable with double ended connection" described in this invention shall mean a heating cable which has electrical termination at the opposite ends of the heating cable. The current in the heating cable with double ended connection flows only in one direction at the same time.

The term "heating cable with single ended connection" described in this invention shall mean a heating cable which has at least one insulated heating means and at least one insulated return conductor. The current in the first heating means and second heating means (or return conductor) flows in the opposite directions at the same time, which completely cancels or significantly reduces electromagnetic field. The heating cable with single ended connection is powered from one end of the heating cable and electrically bridged (interconnected) at the opposite end of the heating cable. It is preferable that the heating and/or return conductors inside the heating cable are twisted against each other to reduce electromagnetic field.

The term "controller" or "electronic controller" described in this invention shall mean an electronic (solid state) or electromechanical power control device, which provides sensing, variation and/or termination of heat radiation in the heater. Usually, the controller is located between the electrical power source and the heating means. However, it also may be designed as a wireless remote controller with the receiver/regulator located between the electrical power source and the heater.

The controller of this invention is capable of comparing an imbalance of current at two (live and neutral) ends of the electrical circuit of the heating cable. It may have a special electronic device to detect the current imbalance in the systems where earth/grounding connection is not available or not required. Alternatively, it may have a device commonly called Ground Fault Circuit Interrupter (GFCI) or Earth Leakage Circuit Breaker (ELCB), which can detect such current imbalance and terminate electrical continuity at a predetermined current leakage limiting setting in the heaters with ground connection. It is preferable, that current leakage setting has a limiting value ranging from 0.1 mA to 100 mA, depending on application of the heater.

The term "NTC sensing means" or "NTC sensing layer" described in this invention shall mean a layer of polymer material possessing negative temperature coefficient (NTC) characteristics. The NTC capability of plastic may depend on the use or design of a single material, or alternatively, the respective quality may be obtained by coating, cross linking, doping, or mixing of several materials to achieve the required NTC performance. As an example, polymers, comprising polyethylene, polyvinyl chloride (PVC), thermoplastic rubber or polyamide may have NTC sensing properties.

For purposes of the invention, the NTC sensing means exhibits NTC characteristics, preferably in such a way that with gradual increase of the temperature (for example up to 60–70° C.), its electrical resistance remains almost unchanged (i.e. it acts as insulation material), but at a certain predetermined temperature it decreases abruptly. Such an abrupt fall of electrical resistance is easily detected by a special control circuit of the controller. It is preferable that the abrupt decrease in electrical resistance of the NTC sensing means occurred, somewhere between 60° C. and 130° C., which will be considered as hot spot limiting temperatures for the purposes of this invention.

The term "insulation means" or "nonconductive means" described in this invention shall mean a layer of nonconductive material, which insulates conductive means. Such insulation means may be in the form of extruded or jacketed polymer, thermoplastic or textile sheet, sleeve, or strip of nonconductive means. As an example, the insulation means may comprise at least one of the following polymers: polyvinyl chloride (PVC), silicon rubber, polyethylene, polypropylene, polyurethane, nylon, polyester, cross-linked polyethylene and PVC, or other appropriate electrical insulating materials. The insulation means may also be utilized as the NTC sensing means in the same heater, depending on the heating element design and its operation temperature.

The term "heater" described in this invention shall mean any electrical heat radiating device which may comprise at least one of the following components: heating means, sensing means, NTC sensing means, current leakage conductor, insulation means, and/or conductor. The heater may have a shape of: (a) round or flat cable, (b) tape, (c) sheet or (d) sleeve. The heater may include a temperature sensing and/or temperature limiting electronic or electromechanical controller.

The term "metal fibers" shall mean metal fibers/filaments, having a denier size of synthetic textile fibers. The diameter of each metal fiber is smaller than the lowest commercially available metal wire Gauge. An example of metal fibers may be Bekinox® stainless steel continuous filament/fiber yarn, manufactured by Bekaert Corporation.

The term "metal wire" shall mean at least one continuous metal strand having a diameter greater than the individual metal fiber/filament described above. The metal wire may contain at least one or a combination of the following metals: copper, iron, chromium, nickel, silver, tin, aluminum, gold or other metals appropriate for the purpose of this invention. The metal wire may be in the form of solid or stranded wire or thin wire, wound around a nonconductive fiber core.

The term "electrically conductive textile fibers" described in this invention shall mean textile threads/fibers or filaments, comprising electrically conductive materials. Electrically conductive textile threads or fibers may be made completely of electrically conductive fibers, such as metal fibers or carbon/graphite containing fibers. The carbon/ graphite containing fibers described in this invention shall mean textile fibers, comprising at least one of the following materials: (a) carbon/graphite fibers, (b) textile fibers, which contain carbon or graphite particles inside the polymer fibers, or (c) synthetic polymer or ceramic fibers coated or impregnated with carbon or carbon/graphite containing material.

Electrically conductive textile fibers can contain metal coated threads or fibers. Such fibers are coated by at least one of the following highly electrically conductive metals: silver, gold, aluminum, copper, tin, nickel, zinc, palladium, their alloys or multi-layer combination. The metal coating may be applied on carbon/graphite threads, extruded polymer filaments, synthetic threads/fibers, fiberglass or ceramic threads/fibers by sputtering, electroplating, electroless deposition or by any other appropriate metal coating or impregnation technique.

Electrically conductive textile fibers may be comprised of nonconductive fibers or particles combined with electrically conductive fibers, particles or layers of electrically conductive coating.

The term "melting fuse" or "fuse" described in this invention shall mean electrically conductive textile fibers which melt at the temperatures between 110° C. and 350° C. Such melting results in termination of the electrical continuity in said electrically conductive textile fibers.

The term "sensing means" described in this invention shall mean at least one of the following materials, which provide temperature sensing in the heater: (a) electrically conductive textile fiber, (b) metal wire, (c) electrically conductive polymer, or other electrically conductive materials. The sensing means is usually disposed in close proximity to the heating means and provides temperature sensing by: (a) a change in electrical resistance of the electrically conductive textile fibers, polymers or wires due to a temperature change in the heater (such as PTC temperature sensing means) or (b) transferring electrical signal from another temperature sensing layer (such as an NTC sensing layer).

The sensing means is always connected to an electronic or electromechanical controller, which varies or terminates electrical power supply to the heater. The sensing means may be electrically connected to another heat sensing material such as an NTC sensing means. The sensing means may have NTC or PTC properties, depending on the heating element design. As an example, carbon fibers may be used as NTC sensors and Nickel wire or its alloys may be used as PTC sensors for sensing means. The sensing means may be encapsulated by a nonconductive material or it may be free of any insulation.

The term "PTC temperature sensing means" described in this invention shall mean sensing means which possesses positive temperature coefficient (PTC) properties. It is preferable that the PTC temperature sensing means has a high resistance value and a steady linear increase of resistance upon increase of the ambient temperature.

The term "current leakage conductor" or "heating element current leakage conductor" described in this invention shall mean a highly electrically conductive material which is connected with: (a) grounding (earth) conductor of the housing/industrial electrical supply system, or (b) one of the current supply lead wires (live or neutral) of the controller. It is preferable that current leakage conductor has a form of either metal mesh or foil, or continuous bare wire, electrically conductive fabric, or combination thereof. It can also comprise conductive polymer, carbon or electrically conductive ceramic fibers. The current leakage conductor can be wrapped or wound around the heating cable, or it can be attached to the heating cable as a highly conductive hot spot detection metal or fabric sheet in case of a flat heater construction.

The term "hot spot" or "local overheating area" described in this invention shall mean the portion of the heater, where the temperature of NTC sensing means is raised above 60° C. during operation of the heater, causing significant reduction of electrical resistance in the portion of said NTC sensing means.

The term "current leakage limiting setting" described in this invention shall mean the maximum allowable current value defined in the controller, at which its electrical or electromechanical circuit terminates the electrical continuity in the heater. Usually, the hot spot current leakage limiting setting is either lower or identical to the current leakage limiting setting for the mechanical (such as metallic or moisture) intrusion in the heater.

The term "mechanical intrusion" or "mechanical damage" described in this invention shall mean at least one of the following mechanical problems, which trip (activate) the GFCI or other current imbalance detection circuits in the controller, terminating electrical continuity in the heating means: (a) damage of outer or inner insulation of the heater, (b) mechanical damage of the conductors and/or heating means (c) moisture penetration into the heating cable, (d) metallic intrusion into the heater, which results in interconnecting (short circuiting) of the heating means, and/or optional return conductor, with current leakage conductor.

The preferred embodiment of the invention shown in FIG. 1 describes a flooring heating cable, having heating means (5) covered by NTC sensing layer (4), heating element current leakage conductors in a form of grounding metal mesh or foil (2) and multi-stranded bare wires (3), return conductor (6) having insulation means layer (7), and two layers of insulation means (1) and (1'), covering the whole heating cable assembly. The heating means (5) and return conductor (6) are connected to each other at one end of the heating cable. As stated above, the return conductor is also considered a heating means, which can either radiate heat, or deliver the current from line to neutral terminals of the heating cable. The important feature of the return conductor is that it provides cancellation of electromagnetic field in the heating cable. The NTC sensing means (4) and current leakage conductors have good mechanical and electrical connection between each other. In the event of local overheating (usually above 60° C.) of the heating means, the NTC layer becomes more conductive in the hot spot area, providing a current leakage path from the heating means (5) to the heating element current leakage conductors (2) and (3), which can be detected by the GFCI or another current leakage detecting circuit of the controller.

Figure 2:
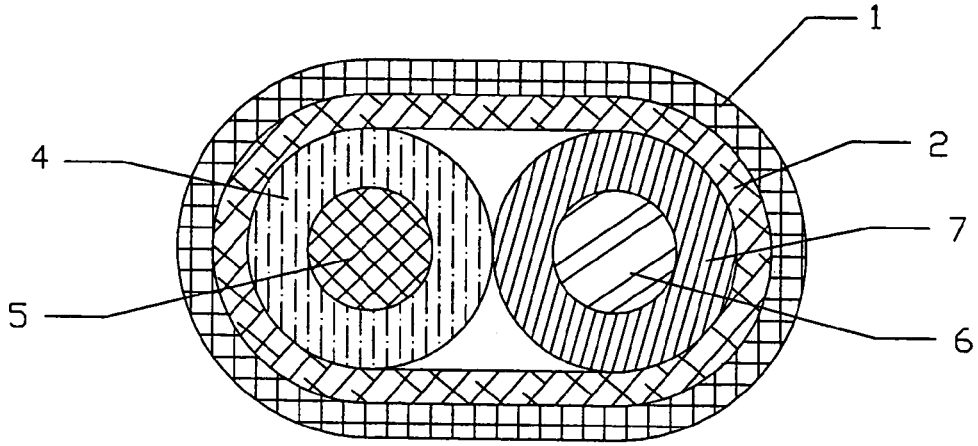
FIG. 2 shows a cross section of a heating cable consisting of one layer of outer insulation means, current leakage conductors in a form of a mesh or foil shield, heating means covered by NTC sensing material and an insulated return conductor.
Figure 3:
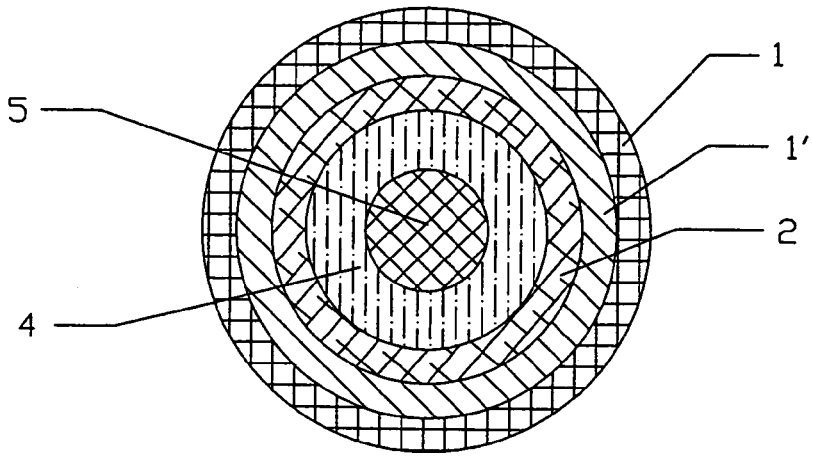
FIG. 3 shows a cross section of a heating cable consisting of two layers of outer insulation means, current leakage conductor in a form of a mesh or foil shield and heating means covered by NTC sensing material.

FIG. 2 and FIG. 3 demonstrate additional examples of the heating cable construction. FIG. 2 shows heating means (5), insulated by NTC sensing layer (4), and insulated return electrode (6) covered by the current leakage conductor (2) in the form of mesh or foil shield. The heating means may comprise a strengthening core made of nonconductive means, metal wires and/or electrically conductive textile fibers. The inclusion of electrically conductive textile fibers in the heating means allows manufacturing the heaters with better flexibility, lower weight and better electrical redundancy in the event of breaking of some of the conductors inside the heating means. In addition, the electrically conductive textile fibers have heat radiating surface areas larger than the same of resistance metal wires. The larger surface area of the electrically conductive textile fibers results in a lower temperature surface density, which reduces thermal deterioration/aging of the plastic insulation. The electrically conductive textile fibers may be in the form of carbon or metal fibers, which can withstand high operating temperatures or they may be in the form of coated or impregnated synthetic fibers with low melting temperatures. Such low melting temperature electrically conductive textile fibers may act as a melting fuse, terminating electrical continuity in the event of local overheating of the heating cable. The ability to fuse the conductor in the heating means makes the heater more reliable, especially in the event of malfunctioning of the controller.

FIG. 3 demonstrates an example of a heating cable without a return conductor. The current leakage conductor (2) is in the form of metal mesh or foil sheath, which covers the NTC sensing means (4). Alternatively, metal wires and/or electrically conductive textile fibers, or combination thereof, can be provided as a current leakage conductor instead of metal mesh/foil cover sheath (2). The optional second insulation means (1') covers the heating element assembly to provide additional mechanical protection.

Figure 4A:
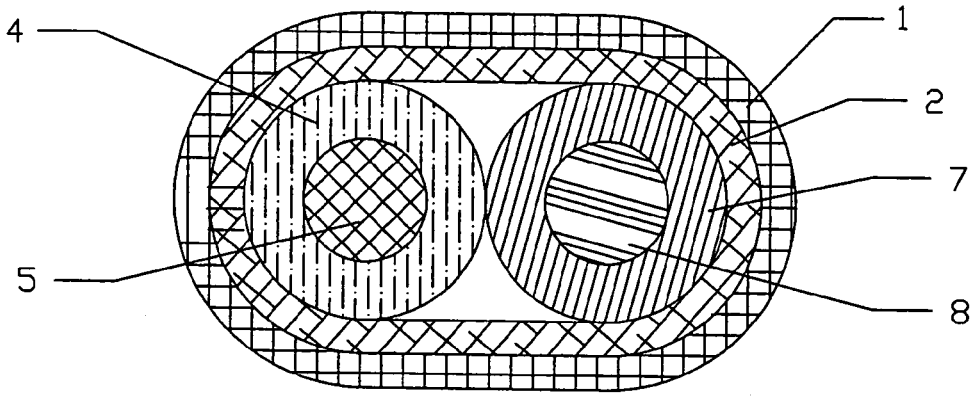
FIG. 4A shows a cross section of a heating cable consisting of one layer of outer insulation means, current leakage conductors in a form of a mesh or foil shield, heating means covered by NTC sensing material and insulated PTC temperature sensing means.
Figure 4B:
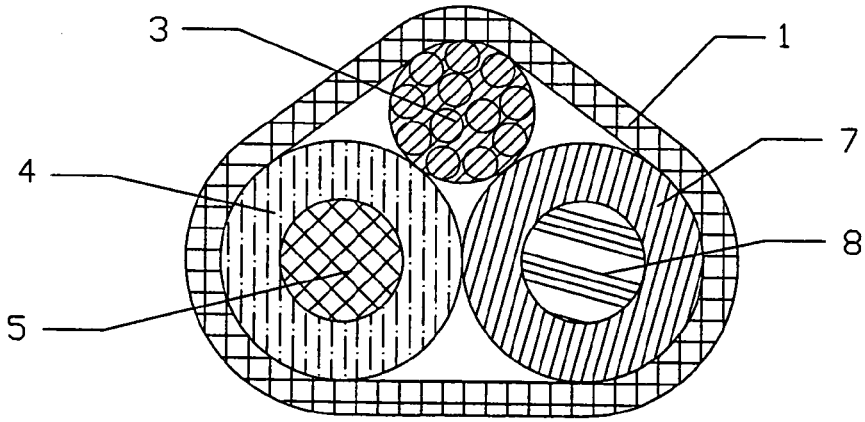
FIG. 4B shows a cross section of a heating cable consisting of one layer of outer insulation means, current leakage conductors having a form of bare wire conductor, heating means, covered by NTC sensing material and insulated PTC temperature sensing means.

FIG. 4A and FIG. 4B show the temperature sensing heating cable with an optional sensing means. The preferred embodiment shows a PTC temperature sensing means (8), covered with insulation (7). The PTC temperature sensing means is usually connected to a separate electrical circuit of the electronic controller to detect an average temperature in the heating cable. The current leakage conductor may be in different forms and materials such as a metal sheath (mesh or foil) covering (2) shown in FIG. 4A, or metal wire/electrically conductive textile fiber conductor (3) shown in FIG. 4B or combination thereof. The current leakage conductor itself may have at least one of the following functions: (a) providing a path for current leakage through NTC layer, hence hot spot detection, (b) providing a radio frequency shield especially if the metallic foil or mesh is utilized, (c) providing a detection path for metallic intrusion into the element assembly and (d) providing a detection path for earth leakage.

Figure 5:
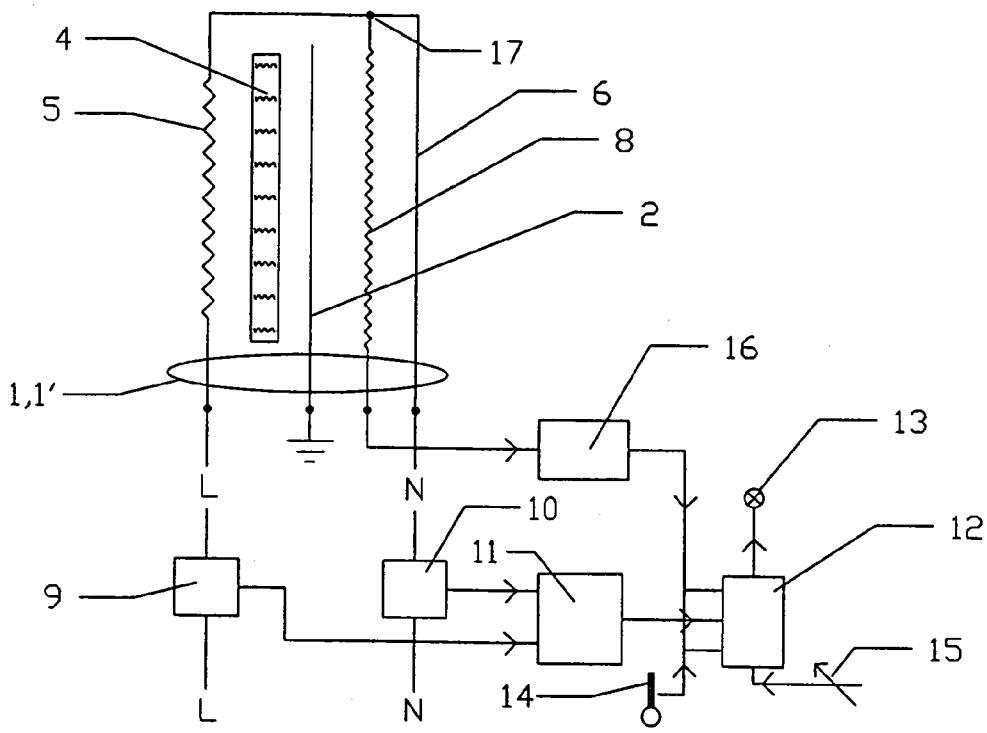
FIG. 5 shows a principal electrical circuit diagram of an electronic control system and heating cable with a single ended connection including optional PTC temperature sensing means and PTC detector.

FIG. 5 shows a principal electrical circuit diagram of the electronic control system and the heating cable with single ended connection for under floor heating. The heater includes floor heating cable and an electronic controller with varied power ratio settings. The heating means (5), which is joined at the far end of the element assembly to the return conductor (6), is separated from the outer current leakage conductor (2) by a layer of NTC sensing means (4). This material is usually in the form of, but not restricted to, doped Nylon, PVC, Polyethylene or other traditional insulation polymers.

As the temperature of the NTC layer rises in the local overheating area, the resistance falls. This effect usually becomes apparent at around 60–70° C. degrees, with an almost exponential response above this level. Any hot spot anywhere along the length of such heating cable assembly will result in current leakage to earth via the heating element current leakage conductor.

The electronic controller detects a hot spot by comparing the current flowing in the live connection (shown as "L") of the heating element with the current flowing in the return wire to neutral connection (shown as "N"). The comparison is made through current detectors (9) and (10) and comparator logic device (11). Any current imbalance is due to a leakage, via the NTC sensing layer, to earth via the heating element current leakage conductors. Such current imbalance detection is similar to the manner in which a regular ELCB (GFCI) works. The novelty of the preferred embodiment of the invention is not just the means (ground leakage) of detection, but the fact that the same current leakage detector can be used for hot spot detection as well as normal earth fault detection and metallic intrusion detection. This system also dispenses with the need for a separate sensor wire to detect the NTC leakage and send a signal to the controller.

The NTC hot spot detector circuit can take many forms, ranging from a dual counter wound toroidal transformer with a detector winding, to the simplified electronic type seen in FIG. 5.

The electronic controller's current detectors measures the volt drop across shunt resistors, amplifies and feeds the resultant voltages to a simple comparator circuit, which in turn disables the power control circuit if the differential was above a predetermined level. There are three distinct levels of detection by the electronic controller. The first level is hot spot detection, the second (higher) level is earth leakage due to mechanical intrusion such as element damage/moisture intrusion, and the third level is direct contact between the heater and the heating element current leakage conductor caused by metallic penetration into the heating cable. It is preferable that the current leakage limiting setting will range from 0.1 MA to 100 mA. It is also preferable to have different current leakage limiting settings for hot spot detection and mechanical intrusion. In the event the current leakage limiting settings for the hot spot is lower than the regular GFCI protection setting for mechanical intrusion, then it is possible to maintain the heater in operating condition even if the heating cable has reached the maximum hot spot temperature level. In that case it is preferable to have electronics, which will turn the system "ON" and "OFF" periodically, preventing the heating cable from overheating. It is also preferable to have a visual and/or sound indicator on the controller, which will warn the user about the hot spot occurrence.

The controller is equipped with power control (12), optional user selectable power ratio (15), optional room or floor thermostats (14) and an optional overheat (hot spot) indicator (13). The heating cable may have an optional PTC temperature sensing means (8) connected to heating means (5) and return electrode (6) in one junction (17). The signal from PTC temperature sensing means (8) transfers to a separate optional PTC detector (16), which is connected with the main power control (12) of the electronic controller. The insulation means (1) covers the heating cable components.

Figure 6:
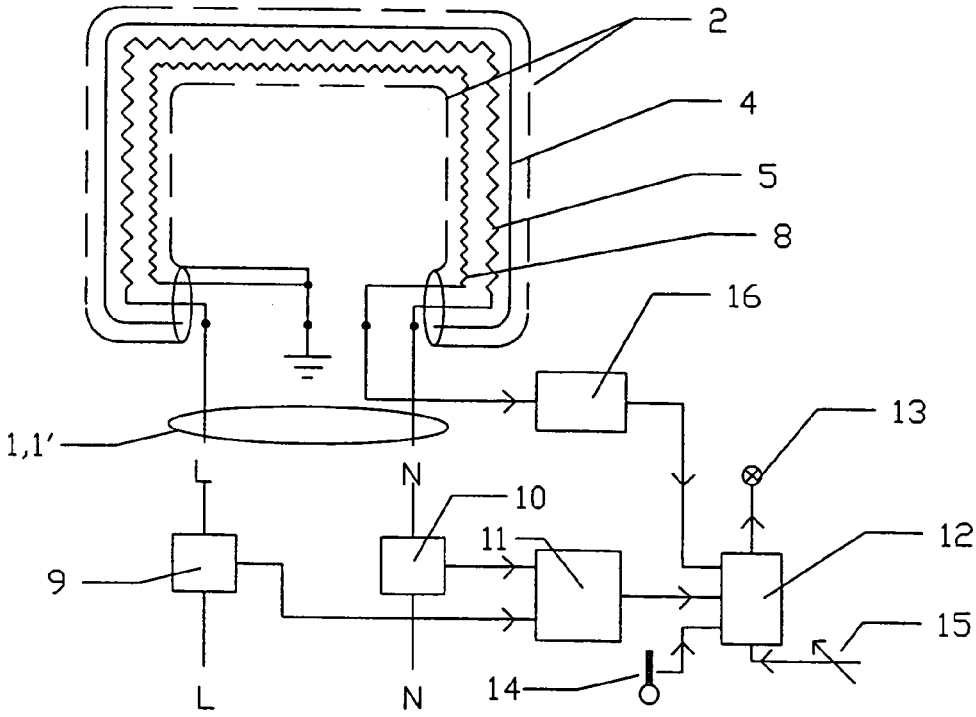
FIG. 6 shows a principal electrical circuit diagram of the electronic control system and heating cable with double ended connection including optional PTC temperature sensing means and PTC detector.

FIG. 6 shows another preferred embodiment of principal electrical circuit diagram of the flooring electronic control system and the flooring heating cable with double ended connection. The main difference between this diagram and the diagram shown in FIG. 5 is that the heating cable does not have the return conductor. The following components are only optional in the heater: (a) PTC temperature sensing means (8), (b) PTC detector (16), (c) room or floor thermostats (14) (d) overheat (hot spot) indicator (13) and (e) user selectable power ratio (15).

Figure 7:
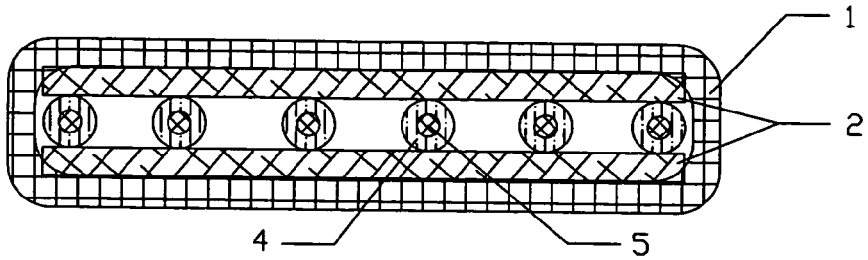
FIG. 7 shows a cross section of a flat heating panel with heating cables covered by a hot spot detection foil sheet on both sides of the heater.

FIG. 7 demonstrates another application of the invention, where the heater is assembled in flat panel constructions which can be used as: (a) a heating pad (b) a panel heater for mirror defogging, (b) a space heater, etc. The proposed flat heater also consists of heating means (5), encapsulated by NTC sensing means (4) which is attached to the current leakage conductor (2). The grounding conductor is attached to the heating cable as a flat metal foil sheet. The whole flat assembly is insulated by the optional insulation means (1). It is possible, for the purposes of this invention, not to use any outer insulation means, or to place insulation means only on one side of the heater.

It is preferable to attach metal foil (or conductive fabric sheet) on both sides of the heating cable to provide better electrical contact of the NTC sensing layer to the current leakage conductor. However, the flat metal foil/fabric sheet can be applied only from one side of the heating cables if dictated by the heating element design.

The flat panel heater can be solid or flexible. It can have different shapes, such as square, rectangular, round or curved. The heater proposed in this invention also can have a shape of a continuous flat strip, sleeve or other shapes appropriate for the purposes of invention, as long as the heater's construction provides a reliable electrical and mechanical connection between the following layers: heating means, NTC sensing means and the current leakage conductor. The proposed heating cable may also have a shape of a flat cable, sheet or sleeve, laminated or extruded into the NTC sensing layer.

Figure 8:
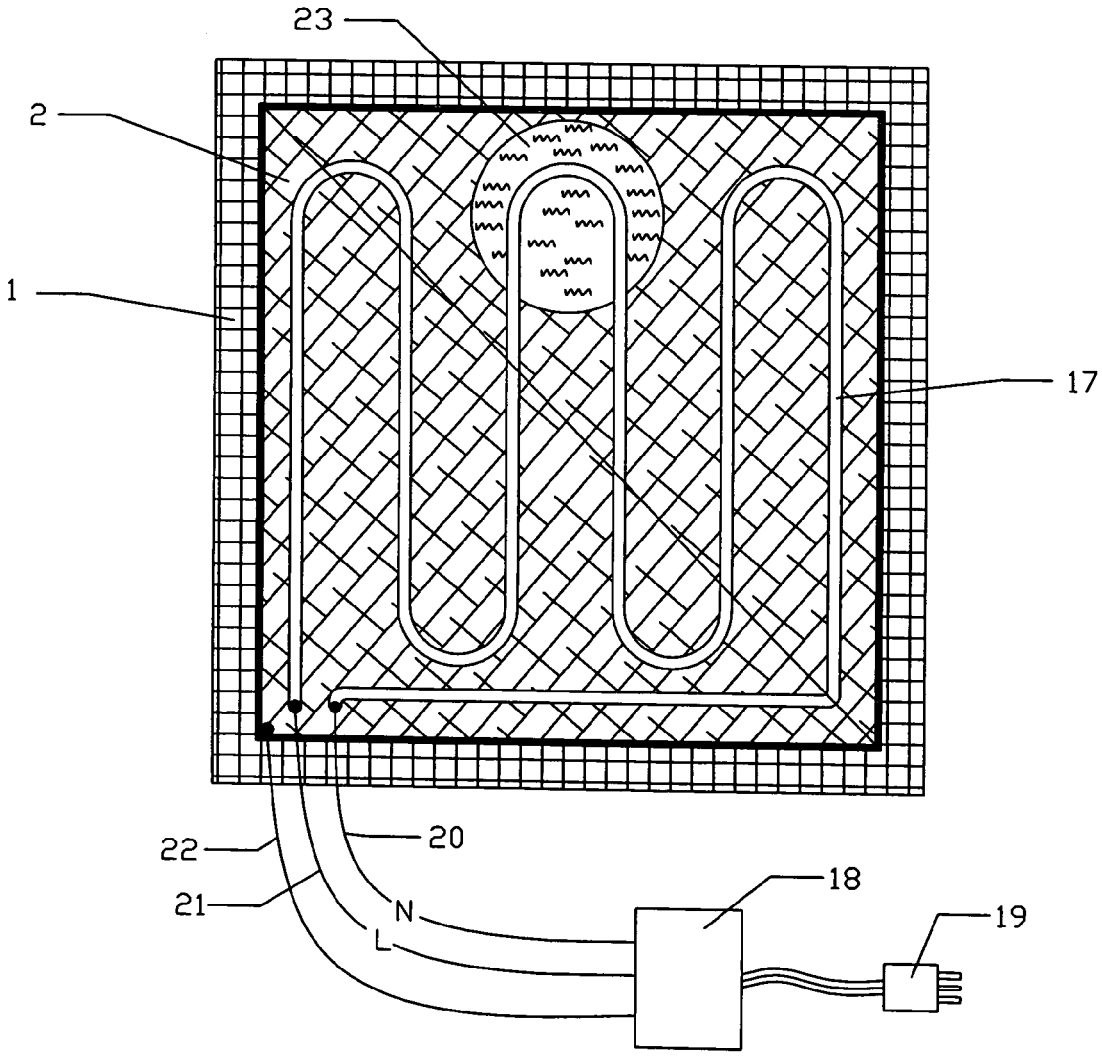
FIG. 8 shows a plan view of a heating pad with heating cables placed on a foil sheet of current leakage conductor.

The FIG. 8 shows an example of a heating pad with hot spot detection. The heating cable (17) is placed on the metal foil sheet (2). The ends of the heating cable are terminated to the live (21) and neutral (20) current supply conductors, attached to the electronic controller (18). The sheet type current leakage conductor (2) is terminated to the cord (22) which is connected to the controller. The whole pad is pouched by PVC insulation, which hermetically seals the whole heating construction. The power cord, having plug (19) with optional ground pin is attached to the controller.

In the event the hot spot (23) occurs inside of the heating pad, the heating cable will leak the current through the NTC sensing layer to the hot spot detection foil conductor (2), which trips the protection system of the controller (for example, GFCI), terminating electrical continuity in the heating pad.

Figure 9:
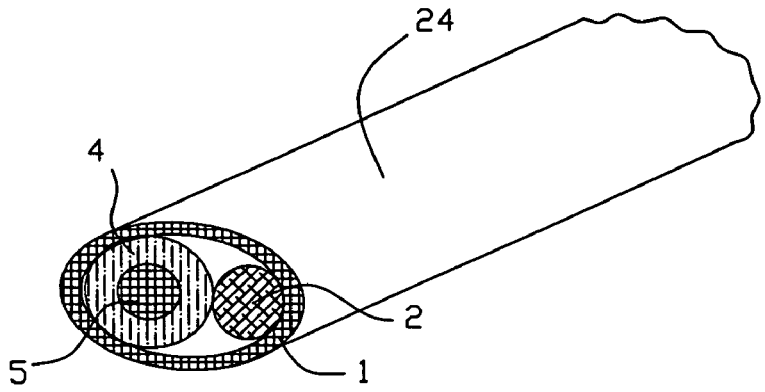
FIG. 9 shows and isometric view of a heating cable with heating means insulated by NTC layer and connected to current leakage conductor.

The same hot spot detection method can be used without reference to actual Earth (or Ground). For example, the electrical blanket (or mattress pad) heating cable (24), shown in FIG. 9, may comprise outer insulation means (1), heating means (5) covered by NTC sensing means (4) and current leakage conductor (2). The current leakage conductor is electrically connected either to the ground circuit, or to one of the current supply (live or neutral) conductors/lead wires. Alternatively, the NTC sensing means can cover not the heating means (5), as shown on FIG. 9, but the current leakage conductor (2). NTC sensing means can also insulate both: heating means (5), and current leakage conductor (2).

Figure 10A:
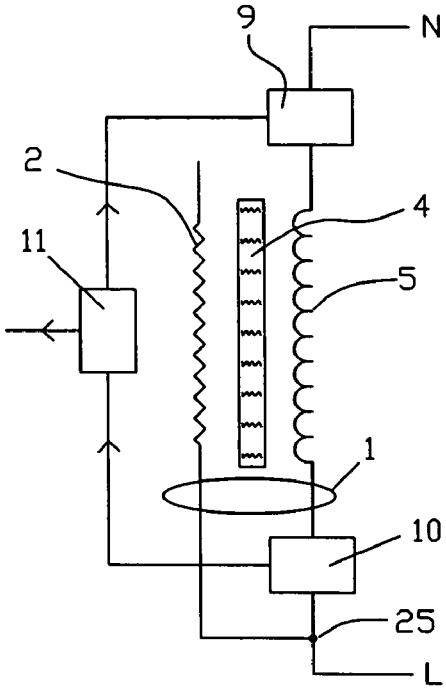
FIG. 10A shows a principal electrical circuit diagram of the electronic control system and heating cable without grounding circuit.
Figure 10B:
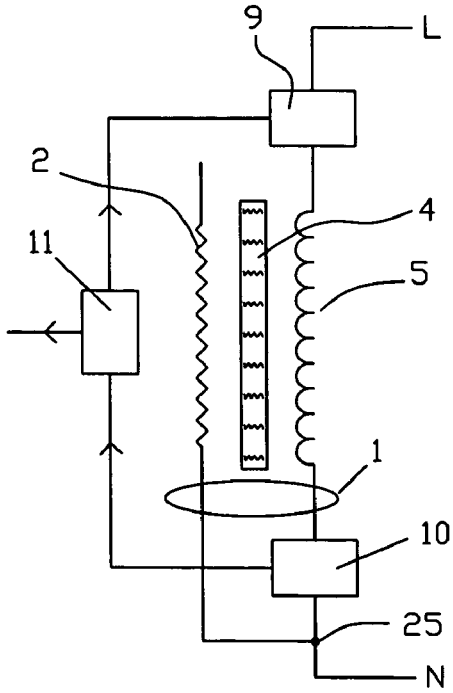
FIG. 10B shows a principal electrical circuit diagram of the electronic control system and heating cable without grounding circuit.

FIG. 10A and FIG. 10B show the preferred embodiment of principal electrical circuit diagram of the electrical heating blanket with hot spot detection, which does not require connection to the ground. FIG. 10A demonstrates the heating cable comprising insulation means (1), heating means (5) and current leakage conductor (2), which is separated from heating means by NTC sensing means (4). The current leakage conductor (2) is connected to the live current supply conductor/lead wire ("L"), which feeds the power to the controller, at a junction (25). In the event of a hot spot occurrence, the current leaking through NTC layer (4) between heating means (5) and current leakage conductor (2), is detected by current detectors (9) and (10). The current imbalance is measured by a leakage comparator logic (11) which sends a signal to the controller's regulation system.

FIG. 10B shows the same principal electrical circuit as shown on FIG. 10B, with the difference that the current leakage conductor (2) is connected to neutral ("N") current supply conductor of the controller (instead of live current supply conductor) at a junction (25). No grounding of current leakage conductor is required in the heater to detect the hot spot by the current leakage imbalance method according to this preferred embodiment of the invention.

The process of manufacturing the temperature sensing heating cables and their assembly in the heating products can be fully automated. Some designs of the heaters may be manufactured in rolls or spools with subsequent cutting to predetermined shapes and sizes.

Further, the proposed heaters can be utilized in, but not limited to: (a) electrically heated blankets, throws, pads, mattresses, pet beds, space heating panels, foot warmers, mats, bedspreads and carpets; (b) electrically heated walls, ceiling and floor electric heaters; sub flooring, office dividers/panels, window blinds, roller shades, mirrors, fan blades and furniture heaters; (c) refrigerator, road, driveway, walkway, window, roof, gutters and aircraft/helicopter wing/blade deicing systems, (d) pipe line, drum and tank electrical heaters, (e) medical/health care, (f) electrically heated food bags or food storage, sleeping bags, towels, boot and glove dryers, etc.

The aforementioned description comprises different embodiments, which should not be construed as limiting the scope of the invention but as merely providing illustrations of some of the presently preferred embodiments of the invention.

While the foregoing invention has been shown and described with reference to a number of preferred embodiments, it will be understood by those possessing skill in the art that various changes and modifications may be made without departing from the spirit and scope of the invention.

What is claimed is:

1. A heater having a durable construction for incorporation into a plurality of articles, said heater comprising:

at least one continuous heating means, at least one continuous current leakage conductor, at least one continuous NTC sensing means, placed between, and electrically connected to said heating means and said current leakage conductor, said NTC sensing means provides current leakage between said heating means and said current leakage conductor;

at least one controller, for simultaneous protection from hot spot and mechanical intrusion into said heater, said hot spot is detected by measuring the imbalance of electrical current flowing between live and neutral ends of the electrical circuit of said heating means.

2. A heater as defined in claim 1 further including at least one insulation means covering at least one side of combination of said heating means, said NTC sensing means and said current leakage conductor.

3. A heater as defined in claim 1 wherein said current leakage conductor is electrically connected to the ground.

4. A heater as defined in claim 1 wherein said current leakage conductor is electrically connected to one of the current supply conductors of said controller.

5. A heater as defined in claim 1 further including sensing means.

6. A heater as defined in claim 5 wherein said sensing means comprises PTC temperature sensing means with PTC detector.

7. A heater as defined in claim 1 wherein said at least one NTC sensing means, placed between, and electrically connected to a return conductor and said current leakage conductor.

8. A heater as defined in claim 1 wherein said heating means comprise a melting fuse, said melting fuse comprising at least one electrically conductive textile fiber as a heating means, said at least one electrically conductive textile fiber melts at a temperature above 110° C. and below 350° C. terminating electrical continuity in said heating means and preventing a fire hazard in said heating cable.

9. A heater as defined by claim 1, further including a visual indicator warning of hot spot on said controller.

10. The heater as defined by claim 1, further including sound signal warning of hot spot in said heater.

11. A method of simultaneous protection by a controller from a hot spot and mechanical intrusion into said heater, recited in claim 1 comprises steps of:

leaking of electrical current between said heating means and said current leakage conductor, through said NTC sensing means, detecting an imbalance of electrical current flowing between live and neutral ends of the electrical circuit of said heating means, terminating of electrical continuity in said heater upon reaching predetermined current leakage limiting setting.

12. A method of simultaneous protection by a controller as defined by claim 11, wherein said controller has separate said current leakage limiting settings for said hot spot and said mechanical intrusion in said heater.

13. A method of simultaneous protection by a controller as defined by claim 12, wherein the hot spot current leakage limiting setting is lower than mechanical intrusion current leakage limiting setting.

14. A method of simultaneous protection by a controller as defined by claim 11, wherein said heater further comprising PTC temperature sensing means and PTC detector to control the maximum heating level in said heater.

15. A method of simultaneous protection by a controller as defined by claim 11, further including a visual indicator warning of hot spot on said controller.

16. A method of simultaneous protection by a controller as defined by claim 11, further including sound signal warning of hot spot in said heater.

17. A method of simultaneous protection by a controller as defined by claim 11 wherein said current leakage conductor is electrically connected to the ground.

18. A method of simultaneous protection by a controller as defined by claim 11 wherein said current leakage conductor is electrically connected to one of the current supply conductors of said controller.

19. A method of simultaneous protection by a controller as defined by claim 11, wherein said controller comprises ground fault circuit interrupter.

* * * * *